US011747760B2

(12) United States Patent
Kakehi

(10) Patent No.: US 11,747,760 B2
(45) Date of Patent: Sep. 5, 2023

(54) IMAGE FORMING APPARATUS

(71) Applicant: CANON KABUSHIKI KAISHA, Tokyo (JP)

(72) Inventor: Yutaka Kakehi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/993,631

(22) Filed: Nov. 23, 2022

(65) Prior Publication Data

US 2023/0087226 A1 Mar. 23, 2023

Related U.S. Application Data

(60) Division of application No. 17/539,764, filed on Dec. 1, 2021, which is a continuation of application No. PCT/JP2020/025929, filed on Jun. 25, 2020.

(30) Foreign Application Priority Data

Jun. 29, 2019 (JP) ..... 2019-122574
Nov. 14, 2019 (JP) ..... 2019-206569

(51) Int. Cl.
*G03G 15/08* (2006.01)
*G03G 15/00* (2006.01)
*G03G 15/16* (2006.01)

(52) U.S. Cl.
CPC ..... *G03G 15/5062* (2013.01); *G03G 15/1675* (2013.01); *G03G 15/5041* (2013.01)

(58) Field of Classification Search
CPC ..... G03G 15/1675; G03G 15/5041; G03G 15/5058; G03G 15/5062; G03G 2215/00067
See application file for complete search history.

(56) References Cited

U.S. PATENT DOCUMENTS 8,843,003 B2 9/2014 Nakao
9,091,968 B2 7/2015 Hara et al.
(Continued)

FOREIGN PATENT DOCUMENTS

CN 104350432 A 2/2015
CN 105425565 A 3/2016
(Continued)

OTHER PUBLICATIONS

International Search Report and Written Opinion dated Sep. 8, 2020, in International Application No. PCT/JP2020/025929.
(Continued)

*Primary Examiner* — Hoang X Ngo
(74) *Attorney, Agent, or Firm* — Venable LLP

(57) ABSTRACT

An image forming apparatus 100, which carries out constant-voltage control of a voltage applied to a transfer member 8 and is capable of executing limiter control for controlling the voltage applied to the transfer member 8 based on a detection result of a current detecting portion 21 so that the detection result falls within a predetermined range, is capable of executing a first mode in which a toner image is transferred onto a recording material P and a second mode in which a plurality of test toner images are transferred onto the recording material P by applying a plurality of different voltages to the transfer member 8, and a controller 50 is capable of carrying out the limiter control while the recording material P passes through the transfer portion 8 in executing the first mode and does not carry out the limiter control while an area onto which the plurality of test images are transferred passes through a transfer portion N2 in executing the second mode.

5 Claims, 10 Drawing Sheets

(56) References Cited

U.S. PATENT DOCUMENTS

| | | | | |
|---|---|---|---|---|
| 9,250,574 | B2 | 2/2016 | Nakaegawa et al. | |
| 9,454,109 | B2 | 9/2016 | Kojima et al. | |
| 9,841,707 | B2 | 12/2017 | Kuroda et al. | |
| 10,990,051 | B2 | 4/2021 | Omata et al. | |
| 11,143,989 | B2 | 10/2021 | Ohta et al. | |
| 2017/0176895 | A1 | 6/2017 | Kuroda et al. | |
| 2017/0195500 | A1 | 7/2017 | Sugimoto et al. | |
| 2018/0196386 | A1* | 7/2018 | Shiraki | G03G 15/1675 |
| 2018/0210376 | A1* | 7/2018 | Hirai | G03G 15/1605 |
| 2018/0253039 | A1 | 9/2018 | Kakehi | |
| 2020/0166881 | A1 | 5/2020 | Omata et al. | |
| 2021/0072673 | A1 | 3/2021 | Kakehi et al. | |

FOREIGN PATENT DOCUMENTS

| | | | |
|---|---|---|---|
| JP | 2003-057968 | A | 2/2003 |
| JP | 2003-131501 | A | 5/2003 |
| JP | 2004-117920 | A | 4/2004 |
| JP | 2008-040177 | A | 2/2008 |
| JP | 2008-102258 | A | 5/2008 |
| JP | 2008-275946 | A | 11/2008 |
| JP | 2010-134184 | A | 6/2010 |
| JP | 2010-145955 | A | 7/2010 |
| JP | 2013-037185 | A | 2/2013 |
| JP | 2013-235058 | A | 11/2013 |
| JP | 2017-116591 | A | 6/2017 |
| JP | 2020-027144 | A | 2/2020 |
| JP | 2020-086107 | A | 6/2020 |

OTHER PUBLICATIONS

Extended European Search Report dated Jun. 29, 2023 in European Application No. 20835071.0.

Notice of Acceptance dated Jul. 14, 2023, in Chinese Application No. 202080046543.0.

* cited by examiner

| | | AMBIENT WATER CONTENT (g/kg) | | | | |
|---|---|---|---|---|---|---|
| | | ≤ 0.9 | … | 8.9 | … | 21.5 ≤ |
| PAPER BASIS WEIGHT (g/m ) | ・ | ・ | | ・ | | ・ |
| | ・ | ・ | | ・ | | ・ |
| | 81～100 | 1000V | … | 500V | … | 200V |
| | 101～125 | 1150V | … | 600V | … | 250V |
| | 126～150 | 1300V | … | 700V | … | 300V |
| | ・ | ・ | | ・ | | ・ |
| | ・ | ・ | | ・ | | ・ |

| A4 SIZE | AMBIENT WATER CONTENT (g/kg) | | | | | | |
|---|---|---|---|---|---|---|---|
| | ≤ 0.9 | 1.73 | 5.8 | 8.9 | 15 | 18.5 | 21.5 ≤ |
| UPPER CURRENT (μA) | 20 | ··· | ··· | 20 | ··· | ··· | 30 |
| LOWER CURRENT (μA) | 15 | ··· | ··· | 13 | ··· | ··· | 12 |

Fig. 7

IMAGE FORMING APPARATUS

FIELD OF THE INVENTION

The present invention relates to image forming apparatuses such as copiers, printers, and FAX machines that use electrophotographic methods and/or electrostatic recording methods.

BACKGROUND ART

Conventional image forming apparatuses using electrophotographic methods electrostatically transfer the toner image from an image bearing member such as a photosensitive member or an intermediate transfer member to a recording material such as paper. This transfer is often performed by applying a transfer voltage to a transfer member such as a transfer roller that forms a transfer portion in contact with the image bearing member. If the transfer voltage is too low, the transfer is not sufficiently performed and the desired image density cannot be obtained, thus "thin image density" may occur. If the transfer voltage is too high, electrical discharge may occur in the transfer portion, and the effect of the electrical discharge may reverse the polarity of the toner charge in the toner image, resulting in "white void" where the toner image is not partially transferred. Therefore, it is necessary to apply an appropriate transfer voltage to the transfer member in order to form high-quality images.

The amount of electrical charge required for transfer varies depending on the size of the recording material and the area ratio of the toner image. Therefore, the transfer voltage is often applied with constant-voltage control, which applies a constant voltage corresponding to a given current density. This is because it is easy to secure the transfer current according to the specified voltage in the area where the desired toner image is located, regardless of the current flowing outside the recording material or in the area where there is no toner image on the recording material. However, the electrical resistance of the transfer members that comprise the transfer portion varies according to product variation, member temperature, accumulated usage time, etc., and the electrical resistance of the recording material that passes through the transfer portion also varies according to the type of recording material, ambient environment (temperature, humidity) etc. Therefore, when controlling the transfer voltage with constant-volume control, it is necessary to adjust the transfer voltage in response to variations in the electrical resistance of the transfer member and recording material.

Japanese Laid-Open Patent Application No. 2004-117920 discloses the following transfer voltage control method in a configuration in which the transfer voltage is controlled by constant-voltage control. Immediately before the start of continuous image formation, a predetermined voltage is applied to the transfer portion without recording material to detect the current value, and a voltage value at which a predetermined target current can be obtained is calculated. Then, the recording material sharing voltage according to the recording material type is added to this voltage value to set the transfer voltage value to be applied by the constant-voltage control during transfer. By this control, the transfer voltage corresponding to the desired target current can be applied by the constant-voltage control regardless of the variation of the electrical resistance value of the transfer portion such as the transfer member and the recording material.

For example, there are different types of recording materials such as fine paper and coated paper due to the difference in surface smoothness, and different types of recording materials such as thin paper and thick paper due to the difference in thickness. The recording material sharing voltage, for example, can be calculated in advance according to these types of recording materials. However, there are many types of recording materials in the market. The electrical resistance of the recording material also depends on the level of wetness of the recording material (the amount of moisture contained in the recording material), but the moisture content of the recording material varies depending on the time it is placed in the environment even if the environment (temperature and humidity) is the same. For this reason, it is often difficult to accurately determine the recording material sharing voltage in advance. If the transfer voltage, including the variation in the electrical resistance of the recording material, is not set to an appropriate value, image defects such as thin image density and white void may occur, as described above.

In response to these issues, Japanese Laid-Open Patent Application No. 2008-102258 and Japanese Laid-Open Patent Application No. 2008-275946 propose to set upper and lower limits of the current supplied to the transfer portion when the recording material is passing through the transfer portion in a configuration in which the transfer voltage is controlled by constant-voltage control. By this control, the current supplied to the transfer portion when the recording material is passing through the transfer portion can be set to a predetermined range of current, so that the occurrence of image defects due to insufficient or excessive transfer current can be suppressed. In Japanese Laid-Open Patent Application No. 2008-102258, the upper limit value is calculated based on environmental information. In Japanese Laid-Open Patent Application No. 2008-275946, the upper and lower limits are determined based on the front and back of the recording material, the type of recording material, and the size of the recording material, in addition to the environment.

On the other hand, there is a method to adjust the transfer voltage by performing an adjustment operation separately from the normal image formation to address the above-mentioned issue. In Japanese Laid-Open Patent Application No. 2013-37185, it is proposed to form multiple test images (hereinafter referred to as "patches") on one recording material while switching the transfer voltage, and to adjust the transfer voltage based on the detection results of the density of each patch.

In methods such as those described in Japanese Laid-Open Patent Application No. 2008-102258 and Japanese Laid-Open Patent Application No. 2008-275946, the transfer voltage is automatically adjusted during image formation. This reduces the burden on the user to adjust the transfer voltage, the time required to adjust the transfer voltage, and the recording material (waste paper) required to adjust the transfer voltage. However, in this method, the transfer voltage is not adjusted by actually looking at the formed image on the recording material or by detecting its density. Therefore, the desired result may not be achieved, for example, the density of the output image may not match the user's preference.

Therefore, while enabling automatic adjustment as described in Japanese Laid-Open Patent Application No. 2008-102258 and Japanese Laid-Open Patent Application No. 2008-275946, in order to meet the needs of various users, it is desirable to be able to execute the adjustment mode in which the image is actually formed on the recording material and adjusted as described in Japanese Laid-Open Patent Application No. 2013-37185.

However, in a configuration where the transfer voltage is automatically adjusted based on the current detected when the recording material Passes through the transfer portion, the patch may not be output under the expected conditions, and proper adjustment may not be possible. In other words, for example, multiple patches may be formed on a single recording material by increasing the absolute value of the transfer voltage for each patch in a stepwise manner. In this case, if the current supplied to the transfer portion is regulated while the recording material is passing through the transfer portion, the transfer voltage can only be changed within a predetermined current range, as shown in parts (a) and (b) FIG. 10. For example, in an area where a transfer voltage with a small absolute value is applied, the current supplied to the transfer portion may fall below the lower limit of the predetermined current range, and adjustments may be made to increase the absolute value of the transfer voltage. This may result in patches that should be output with a transfer voltage with a small absolute value not being output properly. Conversely, in areas where a transfer voltage with a large absolute value is applied, the current supplied to the transfer portion exceeds the upper limit of the predetermined current range, and adjustments are made to reduce the absolute value of the transfer voltage. This may result in patches that should be output at transfer voltages with large absolute values not being output properly. If the transfer voltage that can achieve an image density that meets the user's preference is in an area where the current supplied to the transfer portion is outside the predetermined current range as described above, the output of the patch at the transfer voltage in the area will not be appropriate if the automatic adjustment described above is performed. As a result, it may not be possible to make adjustments according to the user's preference.

In the configuration where the transfer voltage is controlled by constant-voltage control, when the current flowing to the transfer member is out of the predetermined range while the recording material is passing through the transfer portion, the control that changes the target voltage of the constant-voltage control of the transfer voltage so that the current enters the predetermined range is also called "limiter control". In this section, the size (high or low) of the voltage or current is compared in absolute values.

PROBLEM TO BE SOLVED BY THE INVENTION

Accordingly, an objective of the present invention is to provide an image forming apparatus capable of performing adjustment by an adjustment mode to form a test image on the recording material in a configuration capable of limiter control to adjust the transfer voltage based on the transfer current when the recording material is passing through the transfer portion.

MEANS FOR SOLVING THE PROBLEMS

According to one of the embodiments the present invention, an image forming apparatus comprising: an image bearing member for bearing a toner image; a transfer member, to which a voltage is applied, for transferring the toner image born on said image bearing member onto a recording material at a transfer portion; a voltage source for applying the volage to said transfer member: a current detecting portion for detecting a current flowing through said transfer member: and a controller for carrying out constant-voltage control so that the voltage applied to said transfer member is a predetermined voltage while the recording material Passes through said transfer portion, wherein said controller is capable of executing a first mode in which the toner image is formed onto the recording material based on an image information and a second mode in which a plurality of test toner images are formed onto the recording material by applying a plurality of different voltages to said transfer member in order to set a voltage to be applied to said transfer portion in the first mode, and wherein said controller carries out the limiter control while the recording material Passes through said transfer portion in executing the first mode and does not carry out the limiter control while an area onto which said plurality of test images are transferred passes through said transfer portion in executing the second mode, is provided.

BRIEF DESCRIPTION OF THE DRAWINGS

FIG. 7 is a schematic diagram showing an example of the table data of the current range of the paper-feeding section.

EMBODIMENTS FOR CARRYING OUT THE INVENTION

The following is a more detailed description of the image forming apparatus of the present invention in accordance with the drawings.

Embodiment 1

1. Overall Configuration and Operation of the Image Forming Apparatus

Figure 1:
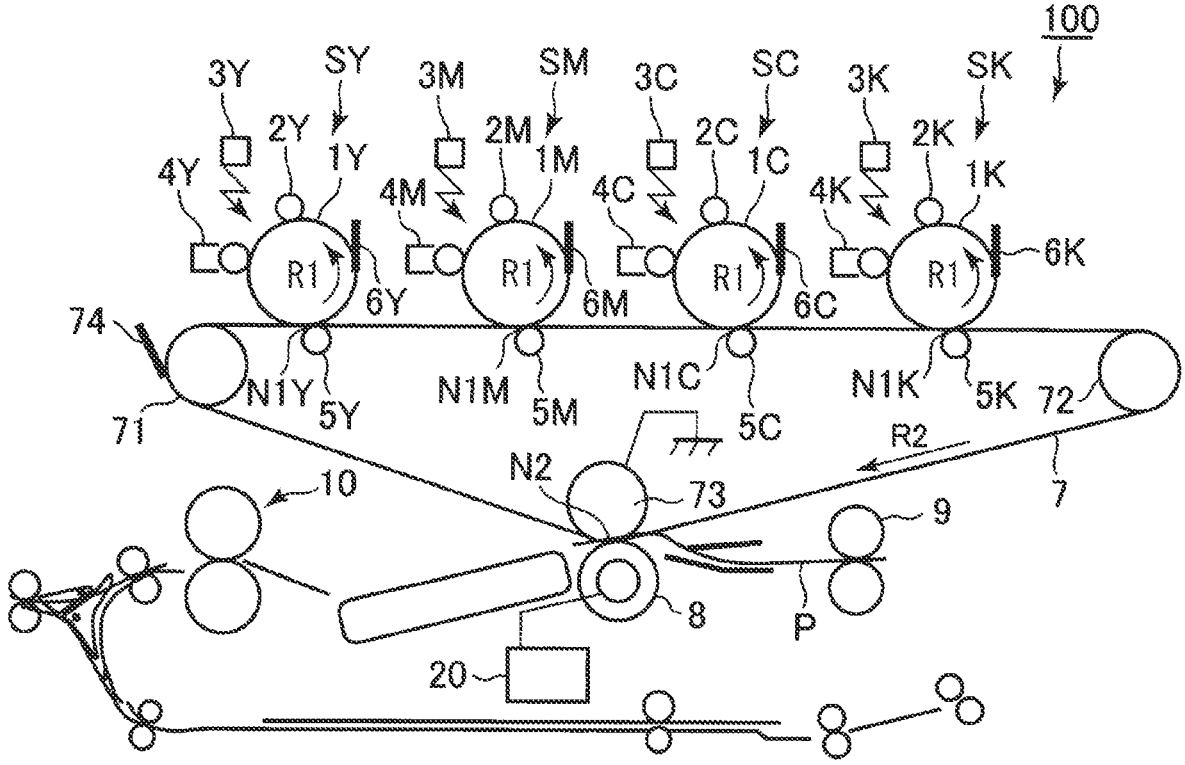
FIG. 1 is a schematic cross-sectional view of the image forming apparatus.

FIG. 1 is a schematic diagram of the image forming apparatus 100 of the present embodiment. The image forming apparatus 100 of the present embodiment is a tandem multifunctional machine (with the functions of a copier, printer, and FAX) that uses an intermediate transfer method and is capable of forming full-color images using electrophotographic methods.

The image forming apparatus 100 has, as a plurality of image forming portions (stations), first, second, third, and fourth image forming portions SY, SM, SC, and SK that form images of yellow, magenta, cyan, and black colors, respectively. Elements having the same or corresponding functions or configurations in each of the image forming portions SY, SM, SC, and SK may be described in a general manner by omitting Y, M, C, and K at the end of the sign indicating that the element is for one of the colors. In the present embodiment, the image forming portion S consists of a photosensitive drum 1, a charging roller 2, an exposure device 3, a developing device 4, a primary transfer roller 5, and a drum cleaning device 6 as described below.

The photosensitive drum1, which is a rotatable drum-type (cylindrical) photosensitive member (electrophotographic photosensitive member) as the first image bearing member that carries the toner image (toner picture), is driven in the direction of the arrow R1 (counterclockwise) in the figure. The surface of the rotating photosensitive drum 1 is uniformly charged to a predetermined potential of a predetermined polarity (negative polarity in the present embodiment) by the charging roller 2, which is a roller-type charging member as a charging means. The charged surface of the photosensitive drum 1 is scanned and exposed by an exposure device (laser scanner device) 3 as the exposure means based on the image information, and an electrostatic image (electrostatic latent image) is formed on the photosensitive drum 1.

The electrostatic image formed on the photosensitive drum 1 is developed (visualized) by supplying toner as developer by the developing device 4 as the developing means, and a toner image is formed on the photosensitive drum 1. In the present embodiment, toner charged with the same polarity as that of the photosensitive drum 1 adheres to the exposed portion (image portion) of the photosensitive drum 1, whose absolute value of electric potential is reduced by exposure after being uniformly charged (reversal development method). In the present embodiment, the normal charging polarity of the toner, which is the charging polarity of the toner during development, is negative. The electrostatic image formed by the exposure device 3 is a collection of small dot images, and by changing the density of the dot images, the density of the toner image formed on the photosensitive drum 1 can be changed. In the present embodiment, the toner image of each color has a maximum density of approximately 1.5 to 1.7, and the amount of toner applied at the maximum density is approximately 0.4 to 0.6 $mg/cm^2$.

An intermediate transfer belt 7, which is an intermediate transfer member composed of an unterminated belt, is arranged as a second image bearing member bearing a toner image so that it can contact the surfaces of the four photosensitive drums 1. The intermediate transfer belt 7 is an example of an intermediate transfer member that feeds the toner image that has been primarily transferred from another image bearing member for secondary transfer to the recording material. The intermediate transfer belt 7 is stretched on a drive roller 71, a tension roller 72, and a secondary transfer opposing roller 73 as a plurality of tensioning rollers. The drive roller 71 transmits driving force to the intermediate transfer belt 7. The tension roller 72 controls the tension of the intermediate transfer belt 7 to a constant level.

The secondary transfer opposing roller 73 functions as an opposing member (opposing electrode) of the secondary transfer roller 8 to be described later. The intermediate transfer belt 7 rotates (moves circumferentially) at a feeding speed (circumferential speed) of approximately 300 to 500 mm/sec in the direction of the arrow R2 (clockwise) in the figure as the drive roller 71 is driven. The tension roller 72 is subjected to a force to push the intermediate transfer belt 7 from the inner peripheral surface side to the outer peripheral surface side by the force of a spring as the attaching means, and this force applies a tension of about 2 to 5 kg to the feeding direction of the intermediate transfer belt 7. A primary transfer roller 5, which is a roller-type primary transfer member as a primary transfer means, is installed on the inner peripheral surface of the intermediate transfer belt 7, corresponding to each photosensitive drum 1. The primary transfer roller 5 is pressed toward the photosensitive drum 1 through the intermediate transfer belt 7 to form a primary transfer portion (primary transfer nip) N1 where the photosensitive drum 1 and the intermediate transfer belt 7 come into contact. The toner image formed on the photosensitive drum 1 is electrostatically transferred (primary transfer) to the rotating intermediate transfer belt 7 by the action of the primary transfer roller 5 in the primary transfer portion N1. During the primary transfer process, a primary transfer voltage (primary transfer bias), which is a direct current voltage of the opposite polarity to the normal charging polarity of the toner, is applied to the primary transfer roller 5 from the primary transfer voltage source (not shown). For example, when forming a full-color image, the toner images of yellow, magenta, cyan, and black colors formed on each photosensitive drum 1 are transferred sequentially so that they are superimposed on the intermediate transfer belt 7.

On the outer peripheral surface side of the intermediate transfer belt 7, a secondary transfer roller 8, which is a roller-type secondary transfer member as a secondary transfer means, is positioned opposite the secondary transfer opposing roller 73. The secondary transfer roller 8 is pressed toward the secondary transfer opposing roller 73 via the intermediate transfer belt 7 to form a secondary transfer portion (secondary transfer nip) N2 where the intermediate transfer belt 7 and the secondary transfer roller 8 are in contact. The toner image formed on the intermediate transfer belt 7 is electrostatically transferred (secondary transfer) to the recording material (sheet, transfer material) P being conveyed between the intermediate transfer belt 7 and the secondary transfer roller 8 by the action of the secondary transfer roller 8 in the secondary transfer portion N2. The recording material P is typically paper (paper for printing), but it is not limited to this: synthetic paper made of resin such as water-resistant paper, plastic sheets such as OHP sheets, cloth, etc. may also be used. During the secondary transfer process, a secondary transfer voltage (secondary transfer bias), which is a direct current voltage of the opposite polarity to the normal charged polarity of the toner, is applied to the secondary transfer roller 8 from the secondary transfer voltage source (high-voltage source circuit) 20. The recording material P is stored in a recording material cassette (not shown) or the like, and is fed one sheet at a time from the recording material cassette by a feeding roller (not shown) or the like, and then fed to the resist roller 9. After the recording material P is stopped by the resist roller 9, it is timed to match the toner image on the intermediate transfer belt 7 and fed to the secondary transfer portion N2.

The recording material P to which the toner image has been transferred is fed to the fixing member 10 as the fixing means. The fixing member 10 heats and pressurizes the recording material P bearing the unfixed toner image to fix (melt, adhere) the toner image to the recording material P. After that, the recording material P is ejected (output) to the outside of the main assembly of the image forming apparatus 100.

The toner remaining on the surface of the photosensitive drum 1 after the primary transfer process (primary transfer residual toner) is removed and collected from the surface of the photosensitive drum 1 by the drum cleaning device 6 as the photosensitive drum cleaning means. In addition, the toner (secondary transfer residual toner) remaining on the surface of the intermediate transfer belt 7 after the secondary transfer process and adhering materials such as paper dust are removed and collected from the surface of the intermediate transfer belt 7 by the belt cleaning device 74 as the intermediate transfer member cleaning means.

Here, in the present embodiment, the intermediate transfer belt 7 is an endless belt with a three-layer structure consisting of a resin layer, an elastic layer, and a surface layer from the inner peripheral side to the outer peripheral side. As a resin material constituting the resin layer, polyimide, polycarbonate, etc. can be used. The thickness of the resin layer is suitable to be 70-100 μm. Urethane rubber, chloroprene rubber, etc. can be used as the elastic material that constitutes the elastic layer. The thickness of the elastic layer is preferably 200-250 μm. As the material for the surface layer, a material that reduces the adhesion of toner to the surface of the intermediate transfer belt 7 and facilitates the transfer of toner to the recording material P in the secondary transfer portion N2 is desirable. For example, one or more types of resin materials such as polyurethane, polyester, epoxy resin, etc. can be used. Alternatively, one or more types of elastic materials (elastic material rubber, elastomer), butyl rubber, or other elastic materials can be used. In addition, these materials can be dispersed with one or more types of powders or particles of materials that reduce surface energy and increase lubricity, such as fluoropolymers, or one or more of these powders or particles with different particle diameters. The thickness of the surface layer is suitable to be 5-10 μm. The electrical resistance of the intermediate transfer belt 7 is adjusted by adding a conductive agent for adjusting the electrical resistance, such as carbon black, and the volume resistivity is preferably set at $1\times10^{9}$ to $1\times10^{14}$ Ω·cm.

In the present embodiment, the secondary transfer roller 8 is composed of a core metal (base material) and an elastic layer formed of ion-conductive foam rubber (NBR rubber) around the core metal. In the present embodiment, the outer diameter of the secondary transfer roller 8 is 24 mm and the surface roughness Rz of the secondary transfer roller 8 is 6.0-12.0 (μm). In the present embodiment, the electrical resistance of the secondary transfer roller 8 is measured to be 1×105 to 1×107Ω when 2 kV is applied at N/N (23° C., 50% RH), and the hardness of the elastic layer is 30 to 40° on the Asker-C hardness scale. In the present embodiment, the width of the longitudinal direction (rotational axis direction) of the secondary transfer roller 8 (the length in the direction substantially perpendicular to the feeding direction of the recording material P) is about 310-340 mm. The longitudinal width of the secondary transfer roller 8 is longer than the largest width (maximum width) of the recording material P (length in the direction substantially perpendicular to the feeding direction) that the image forming apparatus 100 guarantees to convey. In the present embodiment, the recording material P is fed with respect to the center of the longitudinal direction of the secondary transfer roller 8, so all the recording material P that the image forming apparatus 100 guarantees to feed is fed. This makes it possible to stably feed recording materials of various sizes and to stably transfer toner images to recording materials of various sizes.

Figure 2:
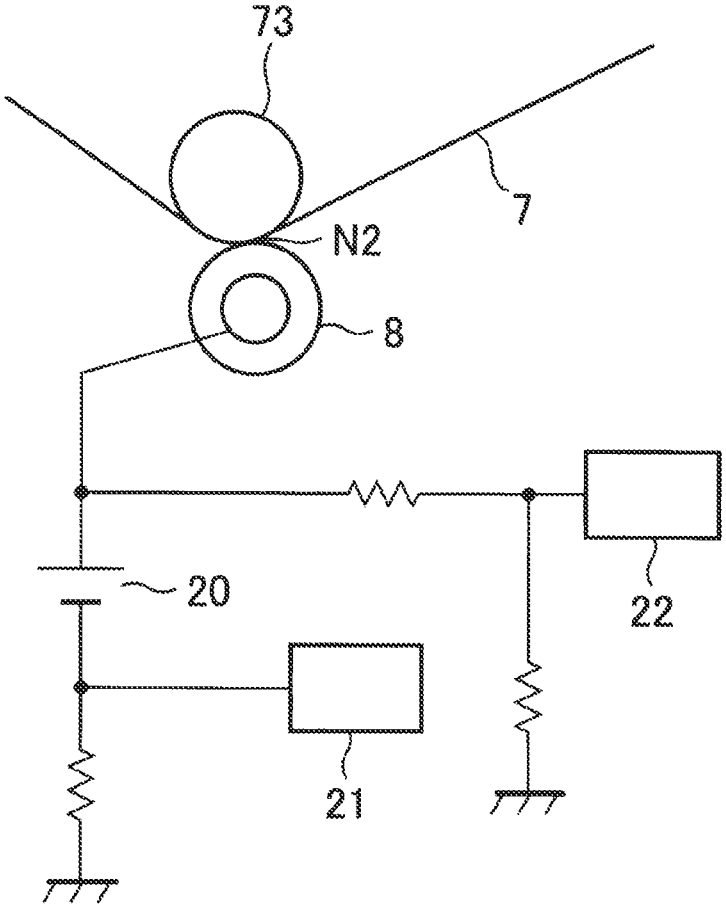
FIG. 2 is a schematic view of a configuration of the secondary transfer.

FIG. 2 is a schematic diagram of the configuration regarding secondary transfer. The secondary transfer roller 8 is in contact with the secondary transfer opposing roller 73 via the intermediate transfer belt 7 to form the secondary transfer portion N2. A secondary transfer voltage source 20 with a variable output voltage value is connected to the secondary transfer roller 8. The secondary transfer opposing roller 73 is electrically grounded (connected to the ground). When the recording material P passes through the secondary transfer portion N2, the secondary transfer voltage, which is a direct current voltage of the opposite polarity from the normal charging polarity of the toner, is applied to the secondary transfer roller 8, and the toner image on the intermediate transfer belt 7 is transferred to the recording material P by supplying the secondary transfer current to the portion N2. In the present embodiment, a secondary transfer current of, for example, +20 to +80 μA is applied to the secondary transfer portion N2 during secondary transfer. In the present embodiment, a roller corresponding to the secondary transfer opposing roller 73 of the present embodiment is used as a transfer member, and a secondary transfer voltage of the same polarity as the normal charge polarity of the toner is applied to it, while the roller corresponding to the secondary transfer opposing roller 8 of the present embodiment may be used as an opposing electrode and electrically grounded.

Figure 3:
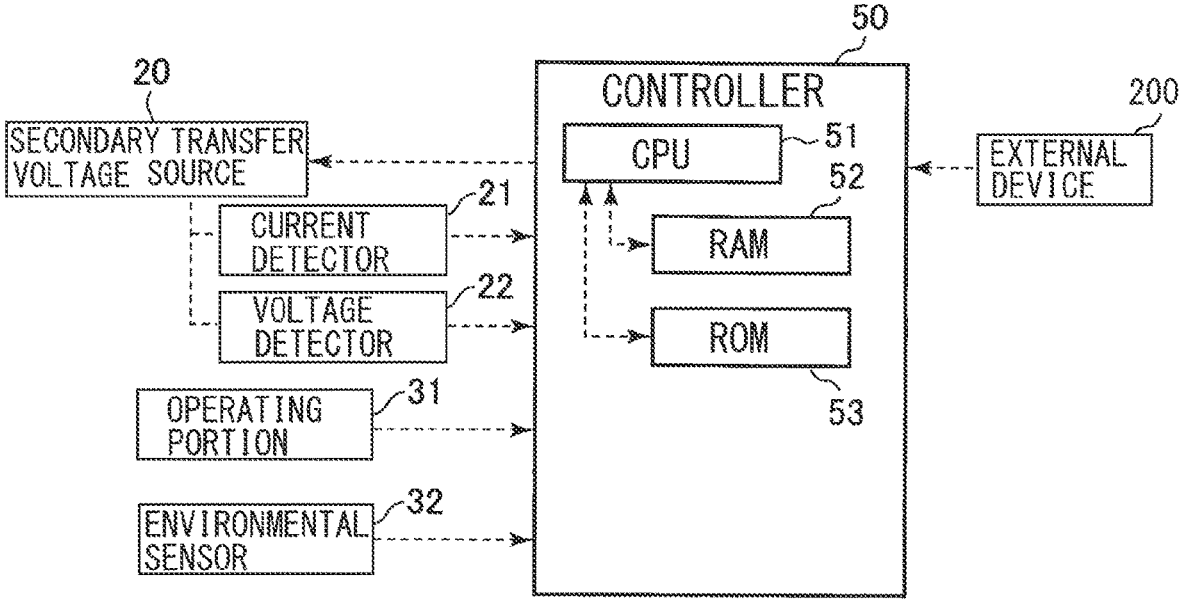
FIG. 3 is a schematic block diagram showing the control scheme of the main portion of the image forming apparatus.

In the present embodiment, the upper and lower limits of the secondary transfer current ("secondary transfer current range") when recording material P is passing through the secondary transfer portion N2 are determined based on various information. As described in detail below, this information includes the following information. First, information on the conditions (such as the type of recording material P) specified by the control portion 31 (FIG. 3) on the main assembly of the image forming apparatus 100 or by an external device 200 (FIG. 3) such as a personal computer that is communicatively connected to the image forming apparatus 100. It is also information about the detection results of the environment sensor 32 (FIG. 3). It is also information about the electrical resistance of the secondary transfer portion N2, which is detected before the recording material P reaches the secondary transfer portion N2. The secondary transfer voltage output from the secondary transfer voltage source 20 is controlled by constant-voltage control so that the secondary transfer current becomes the current in the above secondary transfer current range while detecting the secondary transfer current flowing in the secondary transfer portion N2 when the recording material P is passing through the secondary transfer portion N2. Here, in particular, in the present embodiment, the secondary transfer current range is varied based on information about the width of the recording material P passing through the secondary transfer portion N2. In the present embodiment, information on the width and thickness of the recording material P is obtained based on the information input from the control portion 31 and the external device 200. However, it is also possible to install detection means to detect the width and thickness of the recording material P in the image forming apparatus 100, and to perform control based on the information acquired by this detection means.

The secondary transfer voltage source 20 is connected to a current detection circuit 21 as current detecting means (current detecting portion) to detect the current (secondary transfer current) flowing in the secondary transfer portion N2 (i.e., secondary transfer roller 8 or secondary transfer voltage source 20). Also, a voltage detecting circuit 22 as a voltage detecting means (voltage detecting portion) is connected to the secondary transfer voltage source 20 to detect the voltage (secondary transfer voltage) output by the secondary transfer voltage source 20. It is also possible that the controller 50 functions as the voltage detecting portion and detects the voltage output by the secondary transfer voltage source 20 from the indicated value of the voltage output from the secondary transfer voltage source 20. In the present embodiment, the secondary transfer voltage source 20, the current detection circuit 21, and the voltage detection circuit 22 are provided in the same high voltage board.

2. Control Scheme

FIG. 3 is a schematic block diagram showing the control scheme of the main assembly of the image forming apparatus 100 of the present embodiment. The controller (control circuit) 50 as a control means is composed of a CPU 51 as an arithmetic control means, which is a central component that performs arithmetic processing, a RAM 52 as a storage means, and a memory (storage medium) such as a ROM 53. The RAM 52, which is a rewritable memory, stores information input to the controller 50, detected information, calculation results, etc., and the ROM 53 stores control programs, pre-determined data tables, etc. The CPU 51, RAM 52, ROM 53, and other memories are capable of transferring and reading data from each other.

An external device 200 such as an image reader (not shown) installed in the image forming apparatus 100 or a personal computer is connected to the controller 50. In addition, the operation unit (operation panel) 31 provided in the image forming apparatus 100 is connected to the controller 50. The operation panel 31 consists of a display portion that displays various information to an operator such as a user or a service person under the control of the controller 50, and an input portion for an operator to input various settings, etc. related to image forming to the controller 50. The operation portion 31 may comprise a touch panel or the like equipped with the functions of a display portion and an input portion. Information about the job, including control commands for image formation such as the type of recording material P, is input to the controller 50 from the operation portion 31 or external device 200. The type of recording material P encompasses attributes based on general characteristics such as plain paper, thick paper, thin paper, glossy paper, coated paper, etc., manufacturer, brand name, part number, basis weight, thickness, and any other information that can distinguish the recording material P. The controller 50 can obtain the information on the type of recording material P by directly inputting the information, or it can obtain the information from the information set in relation to the cassette in advance by selecting the cassette of the feeding section that stores the recording material P, for example. The secondary transfer voltage source 20, the current detection circuit 21, and the voltage detection circuit 22 are connected to the controller 50. In the present embodiment, the secondary transfer voltage source 20 applies a secondary transfer voltage, which is a direct current voltage under constant-voltage control, to the secondary transfer roller 8. The constant-voltage control is a control that makes the value of the voltage applied to the transfer portion (i.e., the transfer member) become a roughly constant voltage value. The controller is also connected to the environmental sensor 32. In the present embodiment, the environmental sensor 32 detects the temperature and humidity of the atmosphere inside the casing of the image forming apparatus 100. The temperature and humidity information detected by the environmental sensor 32 is input to the controller 50. The controller 50 can obtain the moisture level (moisture content, absolute moisture level) of the atmosphere inside the casing of the image forming apparatus 100 based on the temperature and humidity detected by the environmental sensor 32. The environmental sensor 32 is an example of an environmental sensing means that detects at least one of the temperature or humidity of at least one of the inside or outside of the image forming apparatus 100. Controller 50 comprehensively controls each part of image forming apparatus 100 to execute image forming operations based on image information from image reading device and external device 200, and control commands from operation portion 31 and external device 200.

Here, the image forming apparatus 100 executes a job (print operation), which is a series of operations to form an image on a single or multiple recording materials P and output it, initiated by a single start instruction (print instruction). A job generally has an image formation process, a pre-rotation process, an inter-paper process when forming images on multiple recording materials P, and a post-rotation process. The image formation process is the period of time during which the electrostatic image of the image to be actually formed on the recording material P and output, the formation of the toner image, the primary transfer of the toner image, and the secondary transfer are performed, and the time of image formation (image formation period) refers to this period. In more detail, the timing during image formation differs at the positions where these processes of electrostatic image formation, toner image formation, primary transfer of the toner image, and secondary transfer are performed. The pre-rotation process is a period of preparatory operations prior to the image forming process, from the time the start instruction is input until the actual image formation begins. The inter-paper process is the period of time corresponding to the interval between recording material P and recording material P when image formation for multiple recording materials P is performed in succession (continuous image formation). The post-rotation process is the period during which the organizing operation (preparation operation) is performed after the image forming process. The non-image forming time (non-image forming period) is a period other than the image forming time, and includes the above-mentioned front rotation process, inter-paper process, post-rotation process, and also the pre-multi rotation process, which is a preparatory operation when the voltage source of the image forming apparatus is turned on or when it returns from sleep mode. In the present embodiment, control is performed to determine the upper and lower limits of the secondary transfer current ("secondary transfer current range") during non-image forming time. In the present embodiment, the series of operations to output the adjustment chart in the adjustment mode described below is also considered to be a job in the adjustment mode to output the adjustment chart.

3. Secondary Transfer Voltage Control

Figure 4:
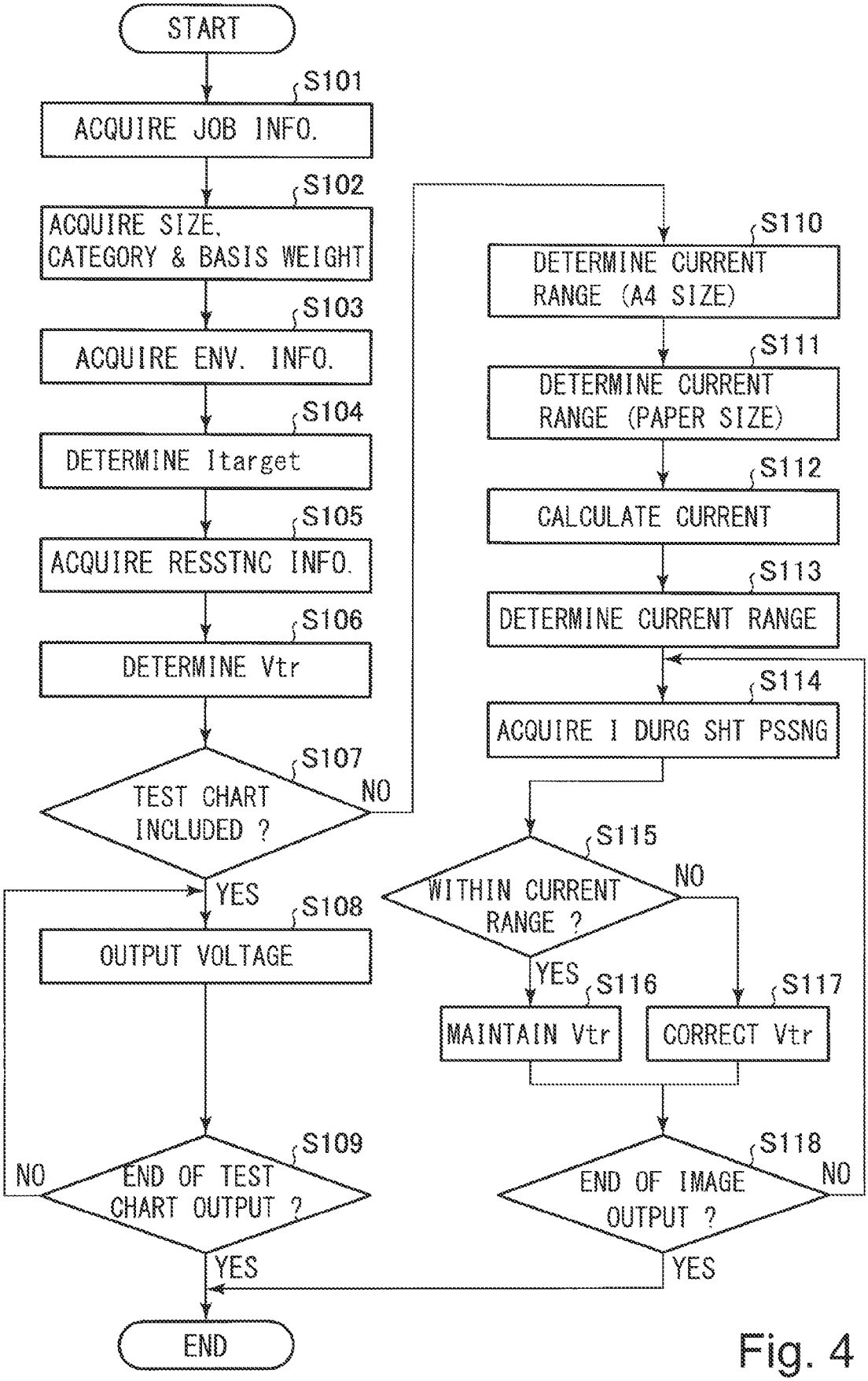
FIG. 4 is a flowchart of the control of Embodiment 1.

Next, the control of the secondary transfer voltage in the present embodiment is explained. FIG. 4 shows a flowchart of the procedure for controlling the secondary transfer voltage in the present embodiment. FIG. 4 shows an example of a case where a job to form an image (also called "normal image" here) or an adjustment chart according to arbitrary image information specified by the operator is executed on a single recording material P.

First, when the controller 50 obtains the information of the job from the operation portion 31 or the external device 200, it starts the operation of the job (S101). In the present embodiment, the information includes the size of the recording material P on which the image is to be formed (width, length), the thickness of the recording material P and related information (thickness or basis weight), and information related to the surface properties of the recording material P such as whether the recording material P is coated paper or not (paper type category information). Controller 50 writes the information of this job to RAM 52 (S102).

Next, the controller 50 acquires the environmental information detected by the environmental sensor 32 (S103). In ROM 53, information showing the correlation between the environmental information and the target value (target current) Itarget of the transfer current for transferring the toner image on the intermediate transfer belt 7 onto the recording material P is stored as table data or the like. Based on the environment information read in S103, the controller 50 obtains the target current Itarget corresponding to the environment from the information showing the relationship between the above environment information and the target current Itarget, and writes it to the RAM 52 (S104).

The reason why the target current Itarget is changed according to the environmental information is that the amount of toner charge varies depending on the environment. The information that shows the relationship between the above environmental information and the target current Itarget is obtained in advance through experiments. In addition to the environment, the amount of toner charge may also be affected by the usage history, such as the timing of refilling the developing device 4 with toner and the amount of toner coming out of the developing device 4. The image forming apparatus 100 is designed to keep the amount of toner charge in the developing device 4 within a certain range in order to suppress these effects. However, if factors other than environmental information that affect the amount of toner charge on the intermediate transfer belt 7 are known, the target current Itarget may be changed according to that information. Also, the image forming apparatus 100 may be provided with measurement means for measuring the amount of toner charge, and the target current Itarget may be changed based on the information on the amount of toner charge obtained by this measurement means.

Figures 5, 6:
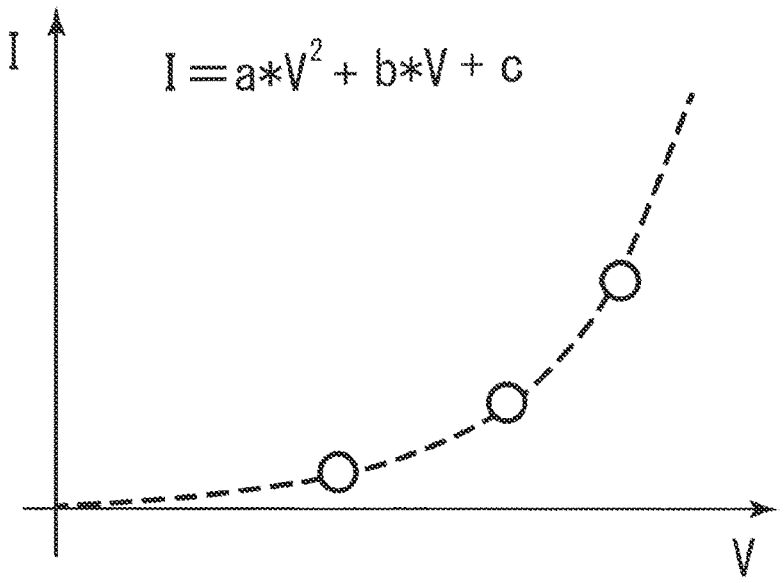
FIG. 5 is a graph showing an example of the relationship between voltage and current in the secondary transfer portion.
FIG. 6 is a schematic diagram showing an example of a recording material shared voltage table data.

Next, the controller 50 obtains information on the electrical resistance of the secondary transfer portion N2 before the toner image on the intermediate transfer belt 7 and the recording material P to which the toner image is transferred reach the secondary transfer portion N2 (S105). In the present embodiment, the information on the electrical resistance of the secondary transfer portion N2 (mainly the secondary transfer roller 8 in the present embodiment) is acquired by the ATVC control (Active Transfer Voltage Control). In other words, with the secondary transfer roller 8 in contact with the intermediate transfer belt 7, a predetermined voltage (test voltage) or current (test current) is supplied from the secondary transfer voltage source 20 to the secondary transfer roller 8. Then, the current value when a predetermined voltage is supplied or the voltage value when a predetermined current is supplied is detected, and the relationship between voltage and current (voltage-current characteristics) is obtained. This voltage-current relationship varies depending on the electrical resistance of the secondary transfer portion N2 (mainly the secondary transfer roller 8 in the present embodiment). In the present embodiment, the relationship between the voltage and the current does not change linearly (proportionally) with respect to the voltage, but changes in such a way that the current is expressed as a polynomial of the second or higher order of the voltage, as shown in FIG. 5. Therefore, in the present embodiment, the predetermined voltage or current to be supplied when obtaining information on the electrical resistance of the secondary transfer portion N2 is set to be multi-level with three or more points (three levels) so that the relationship between the above voltage and current can be expressed as a polynomial equation. The number of these levels can be selected appropriately from the viewpoint of being able to obtain the voltage-current characteristics with sufficient accuracy and not making the time required for control longer than necessary, but typically 10 levels or less is sufficient in many cases.

Next, the controller 50 obtains the target value (target voltage) of the secondary transfer voltage to be applied to the secondary transfer roller 8 from the secondary transfer voltage source 20 (S106). In other words, the controller 50 calculates the voltage value required to apply the target current Itarget with no recording material P in the secondary transfer portion N2, based on the target current Itarget written in RAM 52 in S104 and the relationship between the voltage and current calculated in S105, which is the voltage value Vb. This voltage value Vb corresponds to the secondary transfer portion shared voltage. In addition, ROM53 stores information for determining the recording material shared voltage Vp, as shown in FIG. 6. In the present embodiment, this information is set as table data that shows the relationship between the moisture content of the atmosphere and the recording material shared voltage Vp for each category of the basis weight of the recording material P. The controller 50 obtains the moisture content of the atmosphere based on the environmental information (temperature and humidity) detected by the environmental sensor 32. The controller 50 obtains the recording material shared voltage Vp from the above table data based on the information on the basis weight of the recording material P included in the information on the job obtained in S102 and the environmental information obtained in S103. Then, the controller 50 calculates Vb+Vp, which is the sum of the above Vb and Vp, as the initial value of the secondary transfer voltage Vtr applied from the secondary transfer voltage source 20 to the secondary transfer roller 8 when the recording material P is passing through the secondary transfer portion N2, and this is stored in RAM 52. In the present embodiment, the initial value of the secondary transfer voltage Vtr is obtained before the recording material P reaches the secondary transfer portion N2 and prepares for the timing when the recording material P reaches the secondary transfer portion N2.

The table data for calculating the recording material shared voltage Vp, as shown in FIG. 6, is obtained in advance through experiments. Here, in addition to the information related to the thickness of the recording material (basis weight), the recording material shared voltage (transfer voltage for the electrical resistance of the recording material) Vp may vary depending on the surface properties of the recording material P. Therefore, the above table data may be set so that the recording material shared voltage Vp varies depending on the surface properties of the recording material P and related information. In the present embodiment, the information related to the thickness of the recording material P (and also the information related to the surface properties of the recording material P) is included in the information of the job obtained in S102. However, the image forming apparatus 100 is equipped with measuring means for detecting the thickness of the recording material P and the surface properties of the recording material P, and the recording material shared voltage Vp can be calculated based on the information obtained by the measuring means.

Next, the controller 50 determines whether the image to be formed on the recording material P is a "normal image" according to any image information that the operator actually outputs as a deliverable, or whether it is a predetermined "adjustment chart" for adjusting the operational settings (output conditions) of the image forming apparatus 100 (S107). Controller 50 can make the above judgment based on the information included in the information of the job, which indicates whether the job is in the normal image forming mode (first mode) for outputting a normal image or in the adjustment mode (second mode) for outputting an adjustment chart.

If the controller 50 determines in S107 that the image to be formed on the recording material P is an adjustment chart, it does not perform the limiter control (current limiter control) described below when the recording material P for outputting the adjustment chart is passing through the secondary transfer portion N2 (S108). In other words, in this case, the controller 50 performs the constant-voltage control when the recording material P is passing through the secondary transfer portion N2, so that the voltage applied from the secondary transfer voltage source 20 to the secondary transfer roller 8 becomes the predetermined secondary transfer voltage based on the secondary transfer voltage Vtr (=Vb+Vp) determined in S106. This predetermined secondary transfer voltage is set to Vb+Vp or Vb+Vp+ΔV (adjustment amount) in order to transfer a plurality of patches of the adjustment chart at different secondary transfer voltages, as described in detail later. The Controller 50 continues the process of S108 until the output of the adjustment chart is completed (S109). Here, the case of executing a job to form an adjustment chart on a single recording material P is taken as an example. In the case of a job in which adjustment charts are formed on multiple recording materials P in succession, it is sufficient not to perform the limiter control at the time of secondary transfer of each adjustment chart. The adjustment mode in which the adjustment chart is formed on the recording material P in the present embodiment and output will be described in more detail later.

On the other hand, if the controller 50 determines in S107 that the image to be formed on the recording material P is a normal image, the controller 50 performs the limiter control as described below when the recording material P for outputting the normal image is passing through the secondary transfer portion N2. In other words, in this case, when the recording material P is passing through the secondary transfer portion N2, the controller 50 controls the secondary transfer voltage determined in S106 so that the current flowing in the secondary transfer roller 8 enters the predetermined range when the current is out of the predetermined range. In other words, in this case, the controller 50 limits the range of the current flowing to the secondary transfer roller 8 when the recording material P is passing through the secondary transfer portion N2.

The controller 50 determines the upper and lower limits of the secondary transfer current ("secondary transfer current range") when the recording material P is passing through the secondary transfer portion N2 as follows (S110 to S113). In other words, information for determining the range of the current that may flow through the paper-passing portion when the recording material P is passing through the secondary transfer portion N2 ("paper-passing portion current range (passing portion current range)") from the viewpoint of suppressing image defects, as shown in FIG. 7, is stored in ROM 53. In the present embodiment, this information is set as table data that shows the relationship between the moisture content of the atmosphere and the upper and lower limits of the current that can be applied to the paper-passing portion. This table data is obtained through experiments, etc. in advance. First, the controller 50 calculates the range of the current that may be applied to the paper-passing portion from the above table data based on the environmental information obtained in S103 (SI 10). The range of the current that may flow through the paper-passing portion varies depending on the width of the recording material P. In the present embodiment, the above table data is set assuming a recording material P of A4 size equivalent width (297 mm). Here, the range of current that can be applied to the paper-passing portion from the viewpoint of suppressing image defects may vary depending on the thickness and surface properties of the recording material P in addition to environmental information. Therefore, the above table data may be set so that the range of the electric current varies depending on the information related to the thickness of the recording material P (basis weight) and the information related to the surface properties of the recording material P. The range of current that may be applied to the paper-passing portion may be set as a formula. The range of the current that may be applied to the paper-passing portion may be set as a plurality of table data or formulas for each size of the recording material P.

Next, the controller 50 amends the range of the electric current that may be applied to the paper-passing portion obtained in S110 based on the information of the width of the recording material P included in the information of the job obtained in S102 (S111). The range of the current obtained in S110 corresponds to a width equivalent to A4 size (297 mm). For example, if the width of the recording material P actually used for image formation is equivalent to the width of A5 vertical feed (148.5 mm), that is, half the width of the A4 size equivalent, the upper and lower limits obtained in S110 are halved, respectively, so that the range of current is proportional to the width of the recording material P. In other words, the upper and lower limits of the paper-passing current before correction, which are obtained from the table data in FIG. 7, are Ip_max and Ip_min, respectively and the width of the recording material P when the table data in FIG. 7 is determined is Lp_bas. The width of the recording material P that is actually fed is Lp, and the upper and lower limits of the paper-passing portion current after correction are Ip_max_aft and Ip_min_aft, respectively. The upper and lower limits of the paper-passing portion current after correction can be obtained using Formula 1 and Formula 2 below, respectively.

$$Ip_max_aft = Lp/Lp_bas * Ip_max \quad \text{(Formula 1)}$$

$$Ip_min_aft = Lp/Lp_bas * Ip_min \quad \text{(Formula 2)}$$

Next, the controller 50 calculates the current flowing in the non-paper-passing portion ("non-paper-passing portion current (non-passing portion current)") Inp based on the following information (S112). The information of the width of recording material P included in the information of the job acquired in S102, the information of the relationship between the voltage and the current of the secondary transfer portion N2 in the state that there is no recording material P in the secondary transfer portion N2 obtained in S105, and the information of the relationship between the voltage and the current of the secondary transfer portion N2 obtained in S106. For example, if the width of the secondary transfer roller 8 is 338 mm and the width of the recording material P obtained in S102 is the width equivalent to A5 vertical feed (148.5 mm), the width of the non-paper-passing portion is 189.5 mm, which is the width of the secondary transfer roller 8 minus the width of the recording material P. The secondary transfer voltage Vtr obtained in S106 is, for example, 1000V, and from the relationship between voltage and current obtained in S105, the current corresponding to the secondary transfer voltage Vtr is 40 pA. In this case, the current Inp flowing in the non-paper-passing portion corresponding to the above secondary transfer voltage Vtr can be calculated proportionally as follows.

$$40\ \mu A \times 189.5\ \text{mm}/338\ \text{mm} = 22.4\ \mu A$$

In other words, the current flowing in the non-paper-passing portion can be calculated by a proportional calculation in which the current of 40 μA corresponding to the secondary transfer voltage Vtr above is reduced by the ratio of the width of the non-paper-passing portion of 189.5 mm to the width of the secondary transfer roller 8 of 338 mm.

Next, the controller 50 obtains the upper and lower limits of the secondary transfer current ("secondary transfer current range") when the recording material P is passing through the secondary transfer portion N2, and stores the obtained secondary transfer current range in the RAM 52 (S113). In other words, the controller 50 adds the non-paper-passing portion current Inp calculated in S112 to the upper and lower limits of the paper-passing portion current calculated in S111, and stores it in RAM 52. In other words, the upper and lower limits of the secondary transfer current are I_max and I_min, respectively, when the recording material P is passing through the secondary transfer portion N2. At this time, the upper and lower limits of the secondary transfer current can be calculated using Formula 3 and Formula 4 below, respectively.

$$I_\mathrm{max}=Ip_\mathrm{max}_aft+Inp \quad \text{(Formula 3)}$$

$$I_\mathrm{min}=Ip_\mathrm{min}_aft+Inp \quad \text{(Formula 4)}$$

For example, consider the case where the upper and lower limits of the range of current that can be applied to the paper-passing portion corresponding to the width equivalent to A4 size obtained in S110 are 20 μA and 15 μA, respectively. In this case, when the width of the recording material P actually used for image formation is equivalent to the width of A5 vertical feed, the upper and lower limits of the range of the current that may flow through the paper-passing portion are 10 μA and 7.5 μA, respectively. And when the current flowing to the non-paper-passing portion obtained in S112 is 22.4 μA as in the above example, the upper and lower limits of the secondary transfer current range are 32.4 μA and 29.9 μA, respectively.

Next, the controller 50 detects the secondary transfer current by the current detection circuit 21 when the secondary transfer voltage Vtr is applied while the recording material P exists in the secondary transfer portion N2 after the recording material P reaches the secondary transfer portion N2 (S114). The controller 50 compares the detected secondary transfer current value with the secondary transfer current range obtained in S113, and adjusts the secondary transfer voltage Vtr output by the secondary transfer voltage source 20 as necessary (S115). In other words, the controller 50 maintains the secondary transfer voltage Vtr output by the secondary transfer voltage source 20 as it is (S116) without changing it if the detected secondary transfer current value is within the secondary transfer current range (above the lower limit and below the upper limit) determined in SI 13. On the other hand, if the detected secondary transfer current value is out of the secondary transfer current range determined in S113 (less than the lower limit or greater than the upper limit), the controller 50 corrects the secondary transfer voltage Vtr output by the secondary transfer voltage source 20 so that it becomes a value in the secondary transfer current range (S117). In the present embodiment, when the upper limit is exceeded, the secondary transfer voltage Vtr is reduced, and when the secondary transfer current falls below the upper limit, the adjustment of the secondary transfer voltage Vtr is stopped, and the secondary transfer voltage Vtr is maintained. In the present embodiment, the secondary transfer voltage Vtr is decreased gradually with a predetermined change range ΔVp. In the present embodiment, when the secondary transfer voltage Vtr is below the lower limit, the secondary transfer voltage Vtr is increased, and when the secondary transfer current exceeds the lower limit, the adjustment of the secondary transfer voltage Vtr is stopped and the secondary transfer voltage Vtr is maintained. In the present embodiment, the secondary transfer voltage Vtr is increased gradually with a predetermined change range ΔVp. In the present embodiment, the operation of S114 to S117 is performed by alternately repeating a predetermined detection time (period for detecting the current) and a predetermined response time (period for changing the voltage). This detection time and response time are repeated while there is recording material P in the secondary transfer portion N2 (more specifically, while the image forming area of recording material P is passing through the secondary transfer portion N2). As a result, the secondary transfer voltage Vtr is corrected so that the secondary transfer current detected when recording material P is passing through the secondary transfer portion N2 is within the secondary transfer current range calculated in S113. The controller 50 continues the process of S114-S117 until the output of the desired image is completed (S118). Here, the case of executing a job to form a normal image on a single recording material P is taken as an example. In the case of a job that forms a normal image on multiple recording materials P in succession, the process of S114-S117 should be repeated until all the passing images have been ejected.

Here, the change range ΔVp of the secondary transfer voltage in the limiter control can be set, for example, as follows. From the viewpoint of suppressing density irregularities, etc., the amount of change of the secondary transfer current per unit feeding distance of the recording material P can be set in advance. The amount of change in secondary transfer current due to a single change in secondary transfer voltage can be set based on the amount of change in secondary transfer current per unit transfer distance of recording material P, the transfer speed of recording material P, and the sampling time of secondary transfer current. Then, the change range ΔVp, which is the change amount of the secondary transfer voltage per time, can be set to the change amount of the secondary transfer voltage corresponding to this change amount of the secondary transfer current. In this case, the information on the amount of change of the secondary transfer current per time can be set in advance and stored in ROM 53. Then, the controller 50 can determine the change width ΔVp, which is the change amount of the secondary transfer voltage per time, from the above change amount of the secondary transfer current using the voltage-current characteristics determined by the ATVC control. In other words, the change range ΔVp, which is the amount of change in the secondary transfer voltage corresponding to the predetermined amount of change in the secondary transfer current, is obtained according to the information on the electrical resistance of the secondary transfer portion N2 obtained by the ATVC control. This makes it possible to suppress unevenness in concentration by suppressing sudden changes in the secondary transfer current. In this way, the controller 50 can change the target voltage of the secondary transfer voltage for each predetermined change range in the limiter control. In addition, the controller 50 can change the target voltage of the secondary transfer voltage in the limiter control based on the voltage-current characteristics obtained by applying voltage to the secondary transfer roller 8 with no recording material P in the secondary transfer portion N2.

Alternatively, the voltage-current characteristics determined by the ATVC control can be used to determine the change range ΔVp, which is equivalent to the difference between the detected current and the lower limit (if it is below the lower limit) or upper limit (if it is above the upper limit) of the secondary transfer current range. In other words, the change range ΔVp that can eliminate the difference between the detection current and the lower or upper limits of the secondary transfer current range can be obtained according to the information on the electrical resistance of the secondary transfer portion N2 obtained by the ATVC control and this makes it possible to correct the secondary transfer current to around the secondary transfer current range (typically the lower or upper limit) by changing the secondary transfer voltage once. In this case, a voltage greater than the voltage sufficient to eliminate the difference between the upper or lower limit of the secondary transfer current range may be used as the change range ΔVp. In this case, as long as the secondary transfer current can be sufficiently adjusted to the vicinity of the predetermined current range, the secondary transfer current supplied by the corrected secondary transfer voltage may deviate from the predetermined current range within a sufficiently small range due to control errors, etc. Thus, in the limiter control, the controller 50 controls the secondary transfer voltage so that the difference between the secondary transfer current range and the current indicated by the detection result of the current detection circuit 21 becomes less than a predetermined value (this predetermined value may be zero) by one change.

In the present embodiment, the current flowing in the secondary transfer portion N2 when the recording material P is passing through the secondary transfer portion N2 is considered to be "paper-passing portion current (passing portion current)" and "non-paper-passing portion current (non-passing current)". The passing portion current is the current that flows through the recording material P when it passes through the secondary transfer portion N2. The paper-passing portion current is the current that flows in the area where the recording material P passes through the secondary transfer portion N2 in the direction substantially perpendicular to the feeding direction of the recording material P ("paper-passing portion (passing portion area)"). The non-paper-passing portion current is the current that flows in the area where the recording material P does not pass ("non-paper-passing portion (non-passing portion)") of the secondary transfer portion N2 in the direction that is substantially perpendicular to the feeding direction of the recording material P. The non-passing portion occurs because the longitudinal length of the secondary transfer roller 8 is made larger than the maximum width of the recording material guaranteed by the image forming apparatus 100 to ensure stable transfer and toner image transfer for various sizes of recording material P. The current that can be detected when the recording material P is passing through the secondary transfer portion N2 is the sum of the paper-passing portion current and the non-paper-passing portion current. It is important that the paper-passing portion current is within an appropriate range in order to suppress image defects such as image densification and white void as described above, but it is not possible to detect only the paper-passing portion current. On the other hand, the upper and lower limits of the secondary transfer current ("secondary transfer current range") appropriate for each size of the recording material P are obtained in advance, and the secondary transfer current while the recording material P is passing through the secondary transfer portion N2 according to the size of the recording material P, and control the secondary transfer current while the recording material P is passing through the portion N2 to the value in the secondary transfer current range. However, even if the appropriate secondary transfer current range is determined in advance, the electrical resistance of the secondary transfer roller 8 forming the non-paper-passing portion may vary under various conditions. These various conditions include product variability, environment (temperature and humidity), temperature and moisture absorption of the components, and cumulative usage time (operating status of the image forming apparatus and repeated usage status). Therefore, the variation of the electrical resistance of the secondary transfer roller 8 may cause the appropriate secondary transfer current range to change. In the present embodiment, the non-paper-passing portion current was predicted based on the information about the electrical resistance of the secondary transfer portion N2 when the recording material P was not in the secondary transfer portion N2. However, the present invention is not limited to this and, for example, as described above, an appropriate secondary transfer current range may be obtained in advance for each size of the recording material P, and the limiter control may be performed using the secondary transfer current range according to the size of the recording material P.

Also, depending on the desired accuracy, the limiter control may be performed without considering the non-paper-passing portion current.

4. Adjustment Mode

Next, the adjustment modes in the present embodiment is further explained. There are various possible adjustment modes for forming and outputting adjustment charts on the recording material P, for example, the following ones can be mentioned. There are those for adjusting the latent image forming conditions and developing conditions for forming the toner image on the photosensitive drum 1. There are also those for adjusting the positional conditions for transferring the toner image on the recording material P. There is also one for adjusting the transfer voltage conditions when transferring the toner image onto the recording material P. In the present embodiment, the adjustment mode that forms an adjustment chart on recording is material P and outputs it is the adjustment mode for adjusting the secondary transfer voltage.

In other words, the present embodiment enables automatic adjustment of the secondary transfer voltage by the limiter control described above, and also allows the user to adjust the secondary transfer voltage by outputting an adjustment chart to the recording material P actually used by the user in order to achieve a density that meets the user's preference. In particular, in the present embodiment, the adjustment mode outputs an adjustment chart in which multiple patches are formed on a single recording material P as a predetermined test image while switching the secondary transfer voltage. In the present embodiment, the type of recording material P (size, thickness, paper type category, etc.) used for outputting the adjustment chart can be specified, and the adjustment mode can be executed. In the present embodiment, when outputting this adjustment chart, the aforementioned limiter control is not performed, and Vb+Vp (=Vtr) determined according to the type of recording material P, etc., or Vb+Vp+ΔV (adjustment amount) based on the above, is used to control the secondary transfer voltage with constant-voltage control. In addition, the present embodiment allows the user or other operator to check the output adjustment chart visually or using a colorimeter, and set the secondary transfer voltage (more specifically, ΔV) corresponding to the patches with favorable results.

The adjustment chart output in the adjustment mode is not particularly limited. The shape of each patch of the adjustment chart can be a square or a rectangle. The color of the patches can be determined according to the image defects to be checked and the ease of checking. For example, when the secondary transfer voltage is increased from a low value to a high value, the lower limit of the secondary transfer voltage can be determined from the voltage value at which patches of secondary colors such as red, green, and blue can be properly transferred. The upper limit of the secondary transfer voltage can be determined from the voltage value at which image defects due to the high secondary transfer voltage occur in halftone patches when the secondary transfer voltage is further increased.

Figure 8:
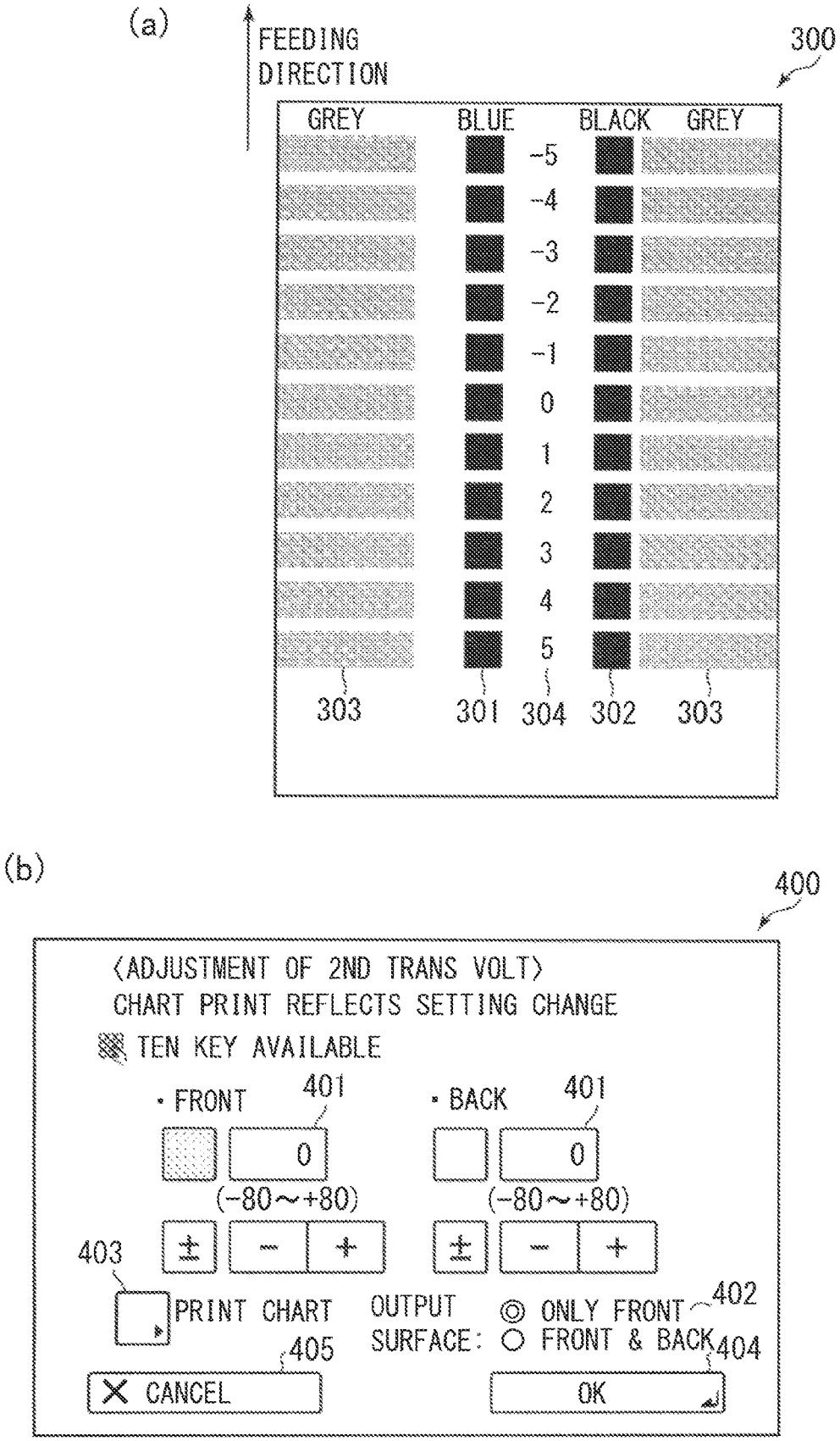
FIG. 8 is an adjustment chart and a schematic diagram showing an example of an adjustment mode setting screen.

Part (a) of FIG. 8 is a schematic diagram of an example of the adjustment chart 300 output in the adjustment mode in the present embodiment. The adjustment chart 300 has a patch set in which one blue solid patch 301, one black solid patch 302, and two halftone patches 303 are arranged in a direction that is substantially perpendicular to the feeding direction (also referred to here as the "width direction"). The patch sets 301-303 in the width direction are arranged in 11 pairs in the feeding direction. In the present embodiment, the halftone patches 303 are gray (black halftone) patches. Here, a solid image is an image with the maximum density level. In the present embodiment, a halftone image is an image with a toner loading level of 10% to 80% when the toner loading level of a solid image is 100%. In addition, in the present embodiment, the adjustment chart 300 has identification information 304 to identify the settings of the secondary transfer voltage applied to each set of patch sets 301-303, corresponding to each of the 11 sets of patch sets 301-303 in the feeding direction. This identification information 304 corresponds to the adjustment values described below. In the present embodiment, there are 11 pieces of identification information (−5~0~+5 in the present embodiment) corresponding to the 11 secondary transfer voltage settings.

The largest recording material P size that can be used in the image forming apparatus 100 of the present embodiment is 13 inches (≈330 mm) in width direction×19.2 inches (≈487 mm) in feeding direction and the adjustment chart 300 corresponds to this size. If the size of recording material P is 13"×19.2" or less (portrait feed) and A3 size (portrait feed) or larger, the chart corresponding to the image data cut out from the chart data shown in the figure according to the size of recording material P is output. At this time, in the present embodiment, the image data is cropped according to the size of the recording material P at the center reference of the tip. In other words, the tip of the feeding direction of the recording material P is aligned with the tip of the feeding direction of the adjustment chart 300 (the upper edge in the figure), and the center of the width direction of the recording material P is aligned with the center of the width direction of the adjustment chart 300, and the image data is cut out. In the present embodiment, the image data is cropped with a margin of 2.5 mm at the edge (both ends of the width direction and both ends of the feeding direction in the present embodiment). For example, when the adjustment chart 300 is output on A3 size (vertically fed) recording material P, the image data of the size of 292 mm on the short side×415 mm on the long side is cut out with a margin of 2.5 mm on each edge. The image corresponding to the cropped image data is then output on A3 size recording material P with the center of the tip as the standard. When recording material P with a width direction size smaller than 13 inches is used, the width direction size of the halftone patch 303 at the edge of the width direction becomes smaller and smaller. When a recording material P smaller than 13 inches in width direction is used, the margin at the back edge of the feeding direction becomes smaller. In the present embodiment, when recording material P smaller than A3 size is used, the adjustment chart can be formed on multiple sheets of recording material P and output as many patches as required adjustment values can be output. In addition to the standard size, the present embodiment can also output the adjustment chart using recording material P of any size (free size) by inputting and specifying it from the operation portion 31 or external device 200.

The size of the patch must be large enough for the operator to easily judge whether or not there is an image defect. For the transferability of blue solid patches 301 and black solid patches 302, the size of the patches should be 10 mm square or larger, and 25 mm square or larger is more preferable, because it is more difficult to judge if the patch size is small. The image defect caused by abnormal discharge that occurs when the secondary transfer voltage is increased in the halftone patch 303 often results in an image defect like a white dot. This image defect tends to be easier to determine even in a small image compared to the transferability of a solid image. However, it is easier to see the image if it is not too small, so in the present embodiment, the width of the feeding direction of the halftone patch 303 is the same as the width of the feeding direction of the solid blue patch 301 and the solid black patch 302. In addition, the interval between the patch sets 301-303 in the feeding direction should be set so that the secondary transfer voltage can be switched. In the present embodiment, the blue solid patches 301 and black solid patches 302 are 25.7 mm×25.7 mm squares (one side is roughly parallel to the width direction). In the present embodiment, the halftone patches 303 at both ends of the width direction are set to be 25.7 mm wide in the feeding direction, respectively, and the width direction extends to the very end of the adjustment chart 300. In the present embodiment, the spacing between the patch sets 301-303 in the feeding direction is set to 9.5 mm. The secondary transfer voltage is switched at the timing when the portion on the adjustment chart 300 corresponding to this interval passes through the secondary transfer portion N2. The 11 patch sets 301-303 of the feeding direction of the adjustment chart 300 are arranged in a range of 387 mm in length so that they fit into the length 415 mm of the feeding direction when the size of recording material P is A3 size.

It is preferable that patches are not formed in the vicinity of the leading and trailing edges of the feeding direction of recording material P (e.g., within about 20-30 mm inward from the edge). This is due to the following reasons. That is, among the edges of the feeding direction of recording material P, there may be image defects that do not occur at the edge of the width direction, but only at the leading or trailing edge. In this case, it may be difficult to determine whether or not the image defect is caused by the secondary transfer voltage variation.

The process conditions for each patch in the adjustment chart 300 are all the same until it is formed on the intermediate transfer belt 7. Then, the secondary transfer voltage when transferring the patches onto the recording material P at the secondary transfer portion N2 is different for each patch set 301-303 arranged in a row in the feeding direction. Due to the difference in the secondary transfer voltage, it is assumed that the density of each patch set 301-303 output on the recording material P will be different.

Figure 9:
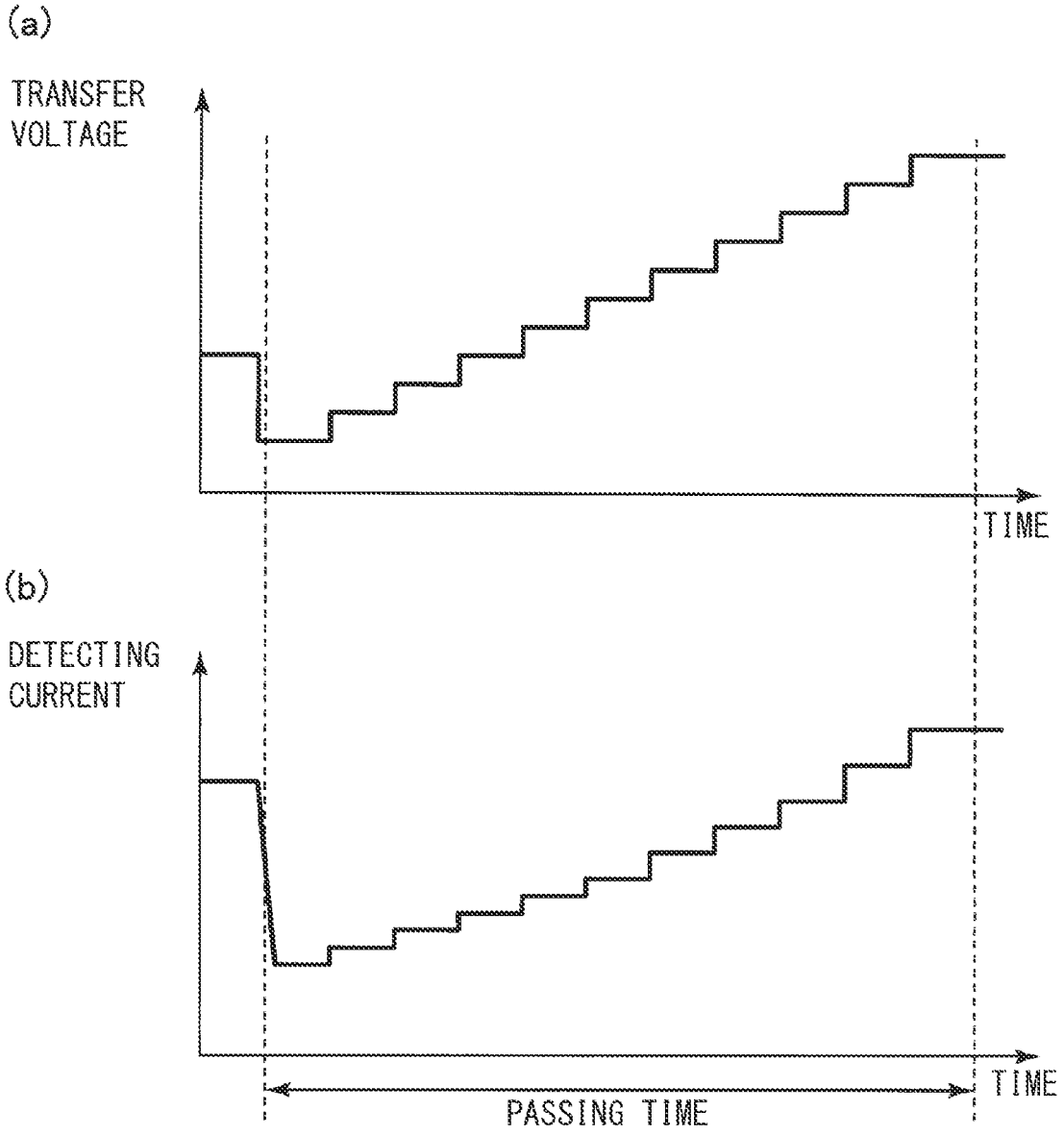
FIG. 9 is a graph showing a transition of the secondary transfer voltage and secondary transfer current at the output of the adjustment chart in Embodiment 1.

FIGS. 9(*a*) and 9(*b*) are graphical diagrams that schematically show the transition of the secondary transfer voltage and secondary transfer current at the output of the adjustment chart 300 in the present embodiment, respectively. The patch sets 301-303 corresponding to the adjustment value "0" indicated by the identification information 304 of the adjustment chart 300 are secondarily transferred to the recording material P with the initial value Vb+Vp (=Vtr) of the secondary transfer voltage determined in S106 of FIG. 4. Then, the patch sets 301-303 (at the tip of the feeding direction) corresponding to the adjustment values smaller than "0" are secondarily transferred to the recording material P with the secondary transfer voltage whose absolute value is smaller than the initial value. On the contrary, the patch sets 301-303 (at the rear end of the feeding direction) corresponding to adjustment values greater than "0" are transferred to the recording material P with a secondary transfer voltage whose absolute value is greater than the initial value. In the present embodiment, for each "1" difference in the adjustment value, the secondary transfer voltage is varied by a predetermined voltage width (the absolute value is increased in the present embodiment), and the secondary transfer voltage is varied in a staircase manner. The range of this variation is several tens to several hundreds of volts, and in the present embodiment, it is 150 volts. For example, the secondary transfer voltage applied to patch sets 301-303 with an adjustment value of "−5" is Vb+Vp+(−5*150V).

The user or other operator confirms the patches of the output adjustment chart 300 by visual inspection or by measurement with a colorimeter (not shown). Then, the user selects the adjustment value of the secondary transfer voltage that enables the operator to output the desired image, and inputs it to the controller 50 via the setting screen displayed on the operation portion 31 or external device 200. This makes it possible to adjust the secondary transfer voltage so that the result according to the operator's preference can be obtained according to the type and condition of the recording material P actually used by the operator. Part (b) of FIG. 8 is a schematic diagram of an example of a setting screen 400 for the operator to input the setting of the adjustment mode. This setting screen 400 has a voltage setting portion 401 for setting the adjustment value of the secondary transfer voltage for the front surface and the back surface of recording material P. This setting screen 400 also has an output side selection portion 402 for selecting whether to output the adjustment chart 300 on one side or both sides of the recording material P. This setting screen 400 also has an output instruction portion 403 for instructing the output of the adjustment chart 300. This setting screen 400 also has a confirmation portion (OK button) 404 for confirming the setting and a cancel button 405 for canceling the change of the setting. When the adjustment value "0" is selected in the voltage setting portion 401, the secondary transfer voltage is set to the initial value Vb+Vp (=Vtr) determined in S106 of FIG. 4, and the center voltage value of the secondary transfer voltage at the output of the adjustment chart 300 is set to that voltage. In addition, when an adjustment value other than "0" is selected, the secondary transfer voltage is adjusted by an adjustment amount ΔV of 150V for each level of the adjustment value, and the center voltage value of the secondary transfer voltage at the output of the adjustment chart 300 is set to that voltage. After the adjustment value is selected, the adjustment chart 300 is output at the selected center voltage value by selecting the output indication portion 403. After the adjustment value is selected, the setting of the secondary transfer voltage is finalized and stored in RAM 52 by selecting the finalization portion 404. If there is no preferred result in the adjustment chart, the center voltage value of the secondary transfer voltage at the output of the adjustment chart 300 can be changed and the output of the adjustment chart 300 can be repeated.

In the present embodiment, the operator checks the patches of the adjustment chart 300 visually or by using a colorimeter to adjust the secondary transfer voltage, but the present invention is not limited to this case. For example, the operator can set the output adjustment chart 300 in the image reading device (not shown) equipped in the image forming apparatus 100, and have the image reading device read the density information (luminance information) of each patch of the adjustment chart. Then, based on the detection results of the density information, the controller 50 can determine the adjustment amount corresponding to the patch that meets the predetermined conditions (e.g., the darkest density) and adjust the secondary transfer voltage. Alternatively, an in-line image sensor may be provided to read the density information (luminance information) of each patch of the adjustment chart 300 when the adjustment chart 300 is output from the image forming apparatus 100. In this case, as above, the controller 50 can adjust the secondary transfer voltage based on the detection results of the image sensor. The aforementioned colorimeter can be a colorimeter external to the image forming apparatus 100 or a colorimeter connected to the image forming apparatus 100. When an external colorimeter is used, the operator can input the desired settings to the controller 50 based on the measurement results. When a colorimeter connected to the image forming apparatus is used, the measurement result is read into the controller 50, and the controller 50 reflects the measurement result in the adjustment value of the secondary transfer voltage so that the image density becomes appropriate.

In the present embodiment, the limiter control described in "3. Secondary transfer voltage control" is performed when not in the adjustment mode. In addition to this limiter control, the secondary transfer voltage source (high voltage source circuit) 20 may be provided with a current limiter by a protection circuit or a high voltage upper limit of the applied voltage from the viewpoint of excessive current suppression. This current limiter by the protection circuit is set wider than the current range to guarantee the image during normal image formation by the limiter control described above. For example, the secondary transfer voltage source 20 used in the present embodiment has a protection circuit of 300~400 μA in order to suppress excessive current, and when a current exceeding this value flows in the secondary transfer portion N2, the secondary transfer voltage source 20 is temporarily shut down to protect the circuit. The voltage that can be applied by the secondary transfer voltage source 20 is about 7-10 kV, and even if the secondary transfer voltage needs to be increased by the limiter control described in "3. Secondary transfer voltage control", the secondary transfer voltage is not increased beyond this value.

If the secondary transfer voltage source 20 has the current limiter by the protection circuit and the high voltage upper limit of the applied voltage from the viewpoint of excess current suppression as described above, these should be effective in the adjustment mode as well. In other words, in the present embodiment, limiter control, which limits the current range to guarantee the image during normal image formation, is turned off when the adjustment chart is output as described above. However, even in this case, the current limiter and the high voltage upper limit of the applied voltage by the protection circuit from the viewpoint of excessive current suppression as described above should be effective.

5. Effects

Figure 10:
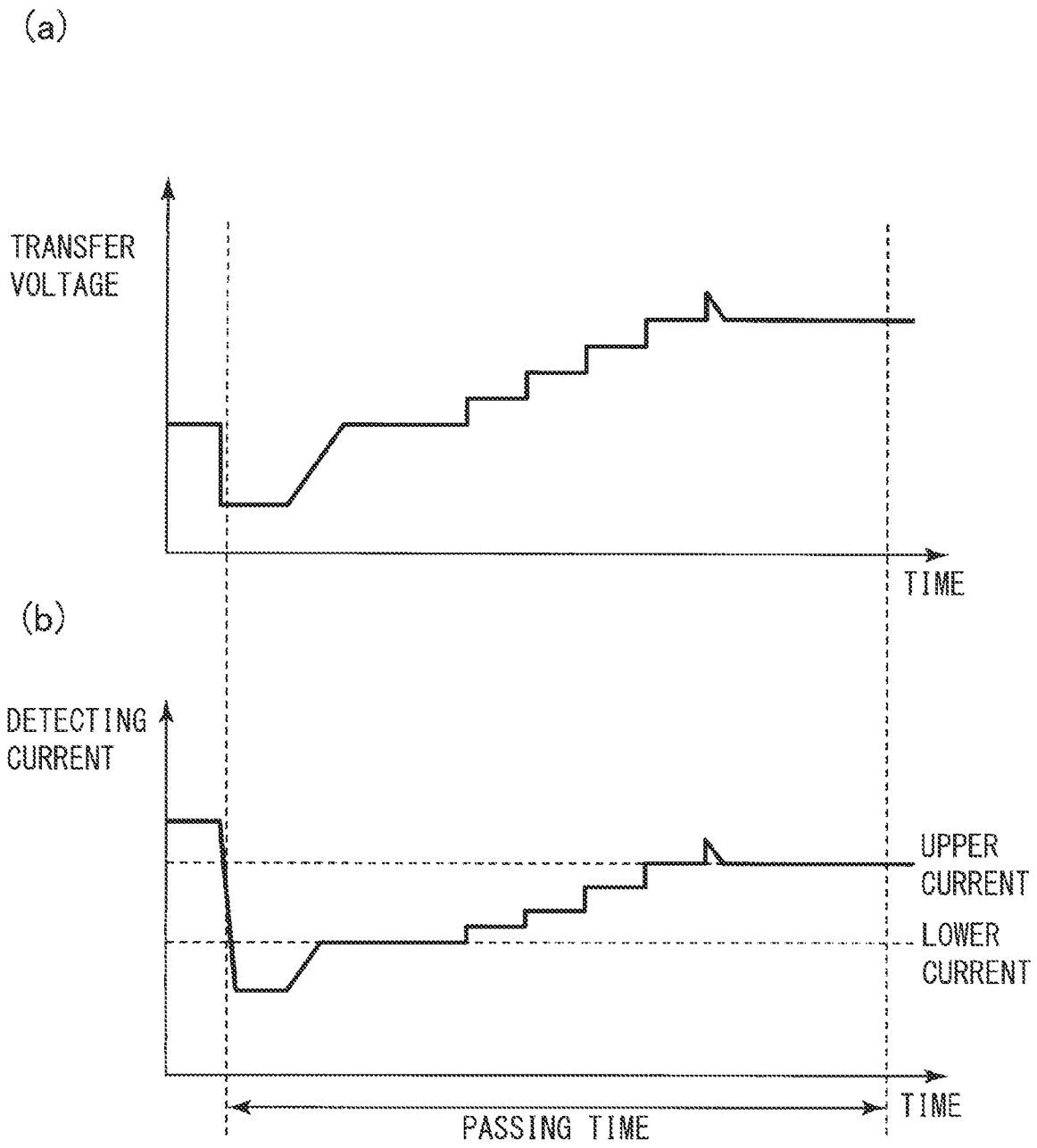
FIG. 10 is a graph to illustrate the issue.

FIGS. 10(*a*) and 10(*b*) schematically show the transition of the secondary transfer voltage and the secondary transfer current when the limiter control is performed at the output of the adjustment chart, unlike the present embodiment. The adjustment chart itself is substantially the same as that of the present embodiment. As mentioned above, when the limiter control is performed at the time of outputting the adjustment chart, the secondary transfer voltage can only be changed within the specified secondary current range. And if the secondary transfer voltage that can achieve the image density that meets the operator's preference is in an area where the secondary transfer current is outside the predetermined range, the output of the patch at the secondary transfer voltage in the area will not be appropriate if the limiter control is performed. As a result, it may not be possible to adjust the patch according to the operator's preference.

On the other hand, as shown in FIGS. 9(*a*) and (*b*), the present embodiment does not perform any limiter control when outputting the adjustment chart. Therefore, the patch can be properly output with the assumed range of secondary transfer voltage. As a result, the adjustment can be made according to the operator's preference.

In the present embodiment, the case where the limiter control is not performed during the entire period when the recording material P outputting the adjustment chart is passing through the secondary transfer portion N2 is explained. However, the present invention is not limited to this, and the limiter control may be performed in the area where no patch is formed with respect to the feeding direction of the recording material P. In the adjustment chart, it is not always the case that patches are formed without gaps from the tip to the rear end of the feeding direction of recording material P and there may be a margin area where no patches are formed on at least one of the tip side or rear end side. In this case, while this blank area passes through the secondary transfer portion N2, it is possible to perform the limiter control. When outputting an adjustment chart for adjusting the secondary transfer voltage, for example, the setting of the secondary transfer voltage corresponding to the adjustment value "0" is set to the value adjusted by the limiter control at the margin area on the leading edge of the feeding direction of recording material P. As a result, the adjustment chart can be output with the secondary transfer voltage settings adjusted so that the secondary transfer current is close to the optimum state, and more appropriate adjustments can be made. In addition, for example, when the adjustment chart is continuously formed on multiple sheets of recording material P, it is also effective to perform limiter control in the margin area at the rear end of the preceding recording material P to prepare for the following recording material P. In other words, while the area where the patch related to the feeding direction of the recording material P that outputs the adjustment chart is formed passes through the secondary transfer portion N2, the limiter control is not performed. The area where the patch is formed is the range from the tip of the area where the patch is transferred to the feeding direction of recording material P to the rear end of the area. When multiple patches are transferred in the feeding direction of recording material P, it is the range from the tip of the leading-edge patch to the trailing edge of the trailing edge patch in the feeding direction of recording material P. Then, it is possible to perform the limiter control while the margin area where the patch on the leading-edge side of the recording material P is not formed, and furthermore, the margin area where the patch on the trailing edge side is not formed passes through the secondary transfer portion N2. It is also possible to enable the limiter control to be performed only when at least one of the leading-edge side or the trailing edge side is passing through the secondary transfer portion N2.

Thus, in the present embodiment, the image forming apparatus 100 is equipped with a controller 50 that controls the constant-voltage so that the voltage applied to the transfer member 8 is a predetermined voltage when the recording material P is passing through the transfer portion N2. This controller can perform limiter control to control the voltage applied to the transfer member 8 based on the detection result of the current detecting portion 21 so that the detection result of the current detecting portion 21 is within the predetermined range. The image forming apparatus 100 is capable of performing a first mode (normal image forming mode) in which a toner image is transferred to the recording material P. and a second mode (adjustment mode) in which a plurality of test toner images are transferred to the recording material P by applying a plurality of different voltages to the transfer member 8. When the first mode is executed, the controller 50 can execute the limiter control while the recording material P is passing through the transfer portion N2. On the other hand, when the second mode is executed, the controller 50 does not perform the limiter control while the area where multiple test toner images are transferred is passing through the transfer portion N2. In the present embodiment, the test toner image is a toner image for setting the above predetermined voltage (target voltage of transfer voltage) when the first mode is executed. In addition, when the second mode is executed, it is possible for the controller 50 to perform the limiter control while at least some areas other than the area where the plurality of test toner images for the feeding direction of recording material P are transferred are passing through the transfer portion N2. For example, at least part of the area is the blank area where the toner image on the tip side of the recording material P is not transferred with respect to the feeding direction.

As explained above, the present embodiment can output images appropriately by suppressing the occurrence of insufficient or excessive secondary transfer current regardless of the type or state of recording material P when outputting normal images. At the same time, according to the present embodiment, when outputting the adjustment chart, it is possible to output the adjustment chart appropriately without restricting the operation settings, thus enabling the adjustment to be made appropriately according to the operator's preference. Therefore, according to the present embodiment, in a configuration in which limiter control is possible to adjust the secondary transfer voltage based on the secondary transfer current when the recording material P is passing through the secondary transfer portion, it is possible to adjust the secondary transfer voltage based on the secondary transfer current when the recording material P is passing through the secondary transfer portion.

Embodiment 2

Next, another embodiment of the present invention is described. The basic configuration and operation of the image forming apparatus of the present embodiment are the same as those of the image forming apparatus of Embodiment 1. Therefore, elements in the image forming apparatus of the present embodiment that have the same or corresponding functions or configurations as those in the image forming apparatus of Embodiment 1 are indicated with the same marks as those in Embodiment 1, and detailed explanations are omitted.

In Embodiment 1, the limiter control is not performed when the adjustment chart is output (or when the area where the adjustment chart patch is formed passes through the secondary transfer portion). On the other hand, the effect similar to that of Embodiment 1 can be expected by widening the secondary transfer current range (increasing the difference between the upper and lower limits) instead of completely eliminating the limiter control.

Figure 11:
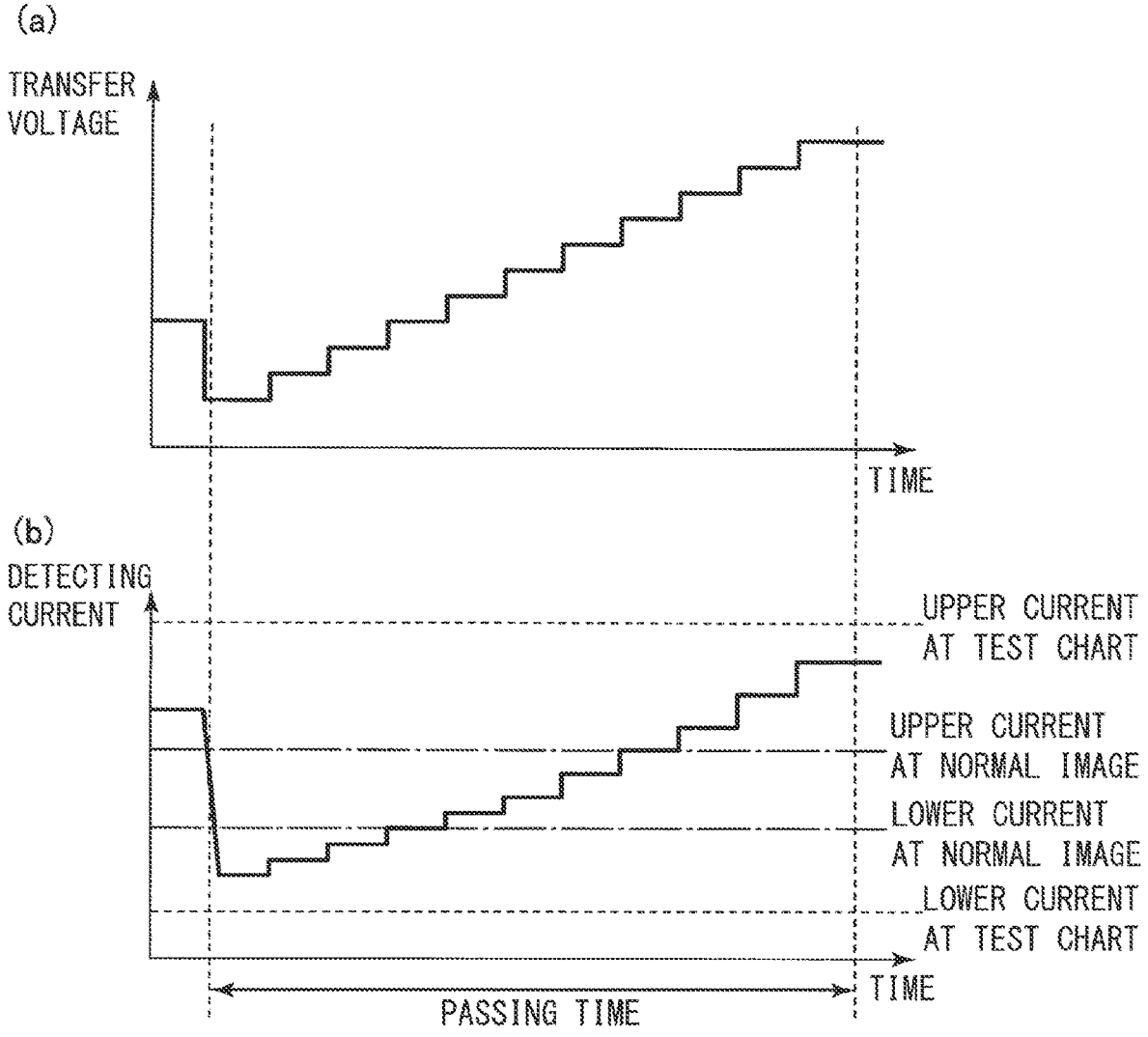
FIG. 11 is a graph showing the transition of the secondary transfer voltage and secondary transfer current at the output of the adjustment chart in Embodiment 2.

To explain further in reference to Embodiment 1, when the controller 50 determines that the image to be formed on recording material P is an adjustment chart in S107 of FIG. 4, it performs the same process as S110-S118 of FIG. 4 in the case of forming a normal image. However, the secondary transfer current range should be wider than in the case of forming a normal image. FIGS. 11(*a*), (*b*) show schematically the transition of the secondary transfer voltage and secondary transfer current in the case of outputting the adjustment chart in the present embodiment. For example, the secondary transfer current range when outputting the adjustment chart can be set in such a way that the limiter control is usually practically disabled. However, the upper and lower limits of this secondary transfer current range are the values of the current range that can be detected by the current detection circuit 21. By changing at least one of the upper or lower limits of the secondary transfer current range (both in the example shown in the figure) to expand the secondary transfer current range, the secondary transfer current range when outputting the adjustment chart can be expanded more than when outputting the normal image.

Thus, in the present embodiment, the controller 50 sets the predetermined range of transfer current to the first predetermined range when limiter control is performed during execution of the first mode (normal image formation mode), and sets the predetermined range of transfer current to the second predetermined range, which is wider than the first predetermined range, when limiter control is performed during execution of the second mode (adjustment mode).

As explained above, the present embodiment has the same effect as Embodiment 1.

[Others]

The present invention is not limited to the above-mentioned embodiment, although it has been explained in terms of a specific embodiment.

The limiter control can be performed by setting only one of the upper and lower limits of the current. For example, if a recording material with a higher electrical resistance than the standard recording material is used, and it is known that the transfer current is often below the lower limit, only the lower limit can be set. Conversely, if a recording material with lower electrical resistance than the standard recording material is used, and it is known that the transfer current often exceeds the upper limit, then only the upper limit can be set. In other words, to keep the transfer current within a predetermined range in the limiter control includes setting the current above the lower limit, below the upper limit, and above the lower limit and below the upper limit.

In addition, in the above-mentioned embodiments, the recording material is fed with respect to the center of the transfer member in the direction roughly substantially perpendicular to the feeding direction, but this is not limited to the above, and for example, the present invention can be equally applied to a configuration in which the recording material is transferred based on one end side.

Also, the present invention can be equally applied to a monochrome image forming apparatus having only one image forming portion. In this case, the present invention is applied to the transfer portion where the toner image is transferred from the image bearing member, such as a photosensitive drum, to the recording material.

INDUSTRIAL APPLICABILITY

According to the present invention, an image forming apparatus will be provided that can properly perform adjustment by an adjustment mode to form a test image on recording material.

The present invention is not limited to the above embodiments, and various changes and variations are possible without departing from the spirit and scope of the present invention. Therefore, the following claims are attached to publicly disclose the scope of the present invention.

This application claims priority on the basis of Japanese Patent Application 2019-122574 filed Jun. 29, 2019 and Japanese Patent Application 2019-206569 filed Nov. 14, 2019, the entire contents of which are hereby incorporated herein.

The invention claimed is:

1. An image forming apparatus comprising:

an image bearing member configured to bear a toner image;

an intermediate transfer belt to which the toner image is transferred from the image bearing member;

a transfer member, to which a voltage is applied, configured to transfer the toner image from the intermediate transfer belt to a recording material at a transfer portion;

a voltage source configured to apply the voltage to the transfer member;

a current detecting portion configured to detect a current flowing through the transfer member; and a controller configured to carry out constant-voltage control so that the voltage applied to the transfer member is a predetermined target voltage, wherein the controller is capable of executing:

(i) a first control in which, while the recording material passes through the transfer portion, in a case that a detecting result detected by the current detecting portion is within a predetermined range which is determined based on a type of the recording material, the controller carries out the constant-voltage control so that the voltage applied to the transfer member is the predetermined target voltage, and in a case that the detecting result exceeds an upper limit of the predetermined range, the controller changes the predetermined target voltage so that the detecting result does not exceed the predetermined range and carries out the constant-voltage based on the changed target voltage, and (ii) a second control in which, while the recording material passes through the transfer portion, even in a case that the detecting result exceeds the upper limit, the controller does not change the predetermined target voltage and carries out the constant-voltage control so that the voltage applied to the transfer member is the predetermined target voltage.

2. The image forming apparatus according to claim 1, wherein the controller gradually decreases the voltage applied to the transfer member in a case that the detecting result exceeds the upper limit in carrying out the first control.

3. The image forming apparatus according to claim 2, wherein the predetermined current is higher than the upper limit.

4. The image forming apparatus according to claim 1, wherein the controller includes a protection circuit configured to temporarily interrupt the voltage source so that the current flowing through the transfer member does not become equal to or higher than a predetermined current separately from the first control.

5. The image forming apparatus according to claim 2, wherein the protection circuit is validated in carrying out the second control.

* * * * *